US007025655B2

(12) United States Patent
Chase

(10) Patent No.: US 7,025,655 B2
(45) Date of Patent: Apr. 11, 2006

(54) DYNAMIC EYE SIMULATION MECHANISM

(75) Inventor: Peter Chase, Fairfax, CA (US)

(73) Assignee: Folkmanis, Inc., Emeryville, CA (US)

( * ) Notice: Subject to any disclaimer, the term of this patent is extended or adjusted under 35 U.S.C. 154(b) by 371 days.

(21) Appl. No.: 10/289,943

(22) Filed: Nov. 6, 2002

(65) Prior Publication Data

US 2004/0087246 A1 May 6, 2004

(51) Int. Cl.
*A63H 3/38* (2006.01)

(52) U.S. Cl. ..... 446/392; 446/327; 446/330; 446/345; 446/348; 446/389

(58) Field of Classification Search ..... 446/392, 446/343, 344, 345, 347, 348, 351, 389, 342, 446/393, 327, 328, 329, 330
See application file for complete search history.

(56) References Cited

U.S. PATENT DOCUMENTS 1,298,808 A * 4/1919 Smith et al.
1,718,346 A * 6/1929 Freundlich
1,963,164 A * 6/1934 Zaiden
1,979,321 A * 11/1934 Dunner
1,999,730 A * 4/1935 Konoff
2,160,982 A * 6/1939 Paganello
2,161,876 A * 6/1939 Lorenz et al.
2,208,219 A * 7/1940 Maibaum ..... 446/301
2,396,654 A * 3/1946 Herrmann
2,633,670 A * 4/1953 Steuber
2,641,866 A * 6/1953 Schiller ..... 446/342
2,660,830 A * 12/1953 Jentzen
2,753,660 A * 7/1956 Brudney
2,938,302 A * 5/1960 Walss
2,954,639 A * 10/1960 Walss
3,125,826 A * 3/1964 Ostrander
3,757,465 A * 9/1973 Barlow ..... 446/341
4,033,071 A * 7/1977 Strongin et al. ..... 446/177
4,074,460 A * 2/1978 Thorn et al. ..... 446/304
5,679,050 A * 10/1997 LLorens ..... 446/341
6,042,450 A * 3/2000 Leversedge et al. ..... 446/304

FOREIGN PATENT DOCUMENTS

EP 0 150 690 A2 * 8/1985
JP 404180791 A * 6/1992

* cited by examiner

*Primary Examiner*—Boyer D. Ashley
*Assistant Examiner*—Ali Abdelwahed
(74) *Attorney, Agent, or Firm*—H. Michael Brucker

(57) ABSTRACT

A dynamic eye simulation mechanism in which an eye orb having a spherical surface has one area of that surface of a color simulating an eyelid and another area having a representation of an eye iris and surrounding sclera applied thereto wherein the orb is mounted for rotation relative to an eye aperture to simulate an eyelid closing and an eyelid blinking.

22 Claims, 6 Drawing Sheets

DYNAMIC EYE SIMULATION MECHANISM

BACKGROUND OF THE INVENTION

The present invention relates to a dynamic eye simulation mechanism and, in particular, to such mechanisms for use in connection with puppets, dolls and other toys representational of creatures having one or more eyes (hereafter referred to collectively as "puppets").

One of the aspects of dynamic eye operation is the simulation of the action of an eyelid which can cover and uncover the optical components of an eye. The use of mechanical eyelids which cover and uncover an otherwise static eyeball (including an iris and sclera) have long been known and are most commonly found in connection with dolls, the eyelids of which cover the eyeball when the dolls are placed in a supine position.

A common failing of mechanical eyelids which cover and uncover a relatively static eyeball is that the rough handling children's toys inevitably experience frequently results in the eyelid mechanism becoming frozen somewhere between fully opened and fully closed, giving the doll an unnatural and unintended appearance.

Furthermore, prior art mechanisms for simulating eyelid action require that the entire doll be oriented horizontally or vertically in order to effectuate the eyelid action.

BRIEF DESCRIPTION OF THE INVENTION

In the present invention, a dynamic eye simulation mechanism provides a convincing illusion of eyelid action without requiring an eyelid mechanism separate from the eyeball itself, and which, further, does not require any particular orientation of the puppet to effectuate the illusion of eyelids opening or closing. In the present invention, the opening and closing of the eyelids is controllable by manual operation of a mechanism which selectively causes the eyes to appear to open and close (eyelids up or down).

In the present invention, dynamic eyelid operation is simulated by an eye orb having a generally spherical surface, with a first area of its surface colored to simulate an eyelid (eyelid area) and a second area of its surface having the representation of an eye iris and surrounding sclera applied thereto (eyeball area). Such an eye orb is disposed immediately adjacent to an eye aperture in the head of a puppet so that in one position of the eye orb, most of what is seen through the eye aperture is the eyeball area, while in another position of the eye orb, all that is seen through the eye aperture is the eyelid area. Between those two positions, the eye aperture can reveal portions of both the eyelid area and the eyeball area so that the eyelid can be made to appear in any position between fully opened and fully closed.

Unlike the prior art, in the present invention, the dynamic eye simulation mechanism includes an eyelid which is not separate from the orb which represents an eyeball, thus greatly simplifying the mechanism and eliminating the common sources of malfunction.

Accordingly, it is an object of the present invention to provide a dynamic eye simulation mechanism for use in connection with dolls and puppets which provides a simplified mechanism for simulating the operation of an eyelid.

It is a further object of the present invention to provide eyelid simulation mechanisms which do not require a mechanism for the eyelid separate from the eye orb which contains the eye pupil and surrounding sclera.

It is yet another object of the present invention to provide a dynamic eye simulation mechanism which is operable manually with the puppet in any orientation.

The invention possesses other objects and advantages, especially as concerns particular characteristics and features thereof which will be better understood from the following detailed description of the preferred embodiments when read in conjunction with the appended drawing figures.

DETAILED DESCRIPTION OF THE PREFERRED EMBODIMENTS

Figure 1B:
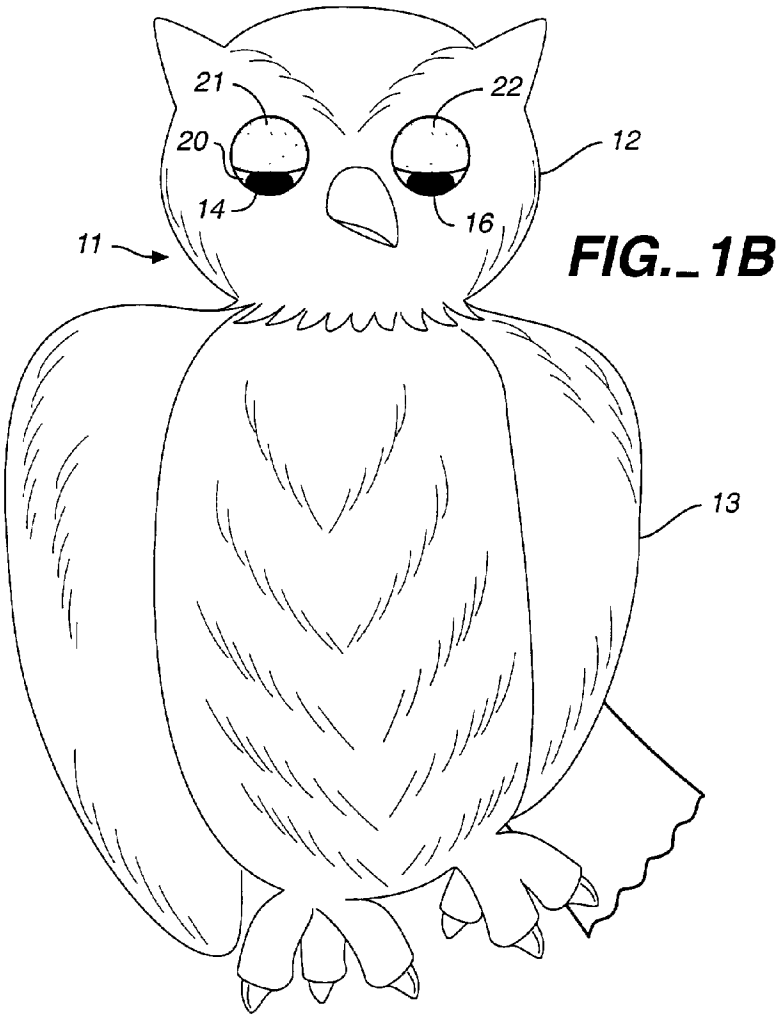
FIG. 1B is the same as FIG. 1A, with the eye mechanism oriented to reveal mostly the eyelid surface.

Referring to FIGS. 1A, 1B, 2A, 2B, 7A, 7B and 8, a puppet 11, in the form of an owl, includes a head member 12 having an interior space 15 and a body member 13 which are physically separate and able to move one relative to the other, as will be more fully described below. The owl puppet 11 is representational of any puppet of the kind in which a human hand can be inserted in order to effectuate certain manipulations that animate the puppet in one way or another. Thus, the outer form of the puppet and what it is intended to represent are not limiting to the invention.

The head member 12 includes a pair of eye apertures 14 and 16 through which eye orbs within the interior space 15 can be seen. While the outer form of the puppet 11 is limited only by the imagination, what is a constant as regards the present invention is the presence of one or more eye apertures, such as eye aperture 16, through which an interior eye mechanism can be seen.

The head member 12 interior space 15 contains part of the dynamic eye simulation mechanism of the present invention, including eye orbs 18 and 19 which are aligned with, and visible through, eye apertures 14 and 16, respectively.

In the preferred embodiment, eye orbs 18 and 19 are spheres, although the present invention retains its advantages where the eye orbs 18 and 19 are not complete spheres, but have spherical surface areas.

A first eye orb surface area (eyelid area) 21 of the eye orb 18 has a generally uniform coloration and simulates an eyelid. Similarly, eye orb 19 has a first surface area (eyelid area) 22 which has a generally uniform coloration and simulates an eyelid. A second area (eyeball area) 20 of the eye orb 18 surface has applied to it a representation of an eye pupil 23 and a surrounding sclera 24 which is adjacent eyelid area 21. In like fashion, the eye orb 19 has applied to a second and adjacent surface area (eyeball area) 26, a representation of an eye pupil 27 and a surrounding sclera 28.

Figure 1A:
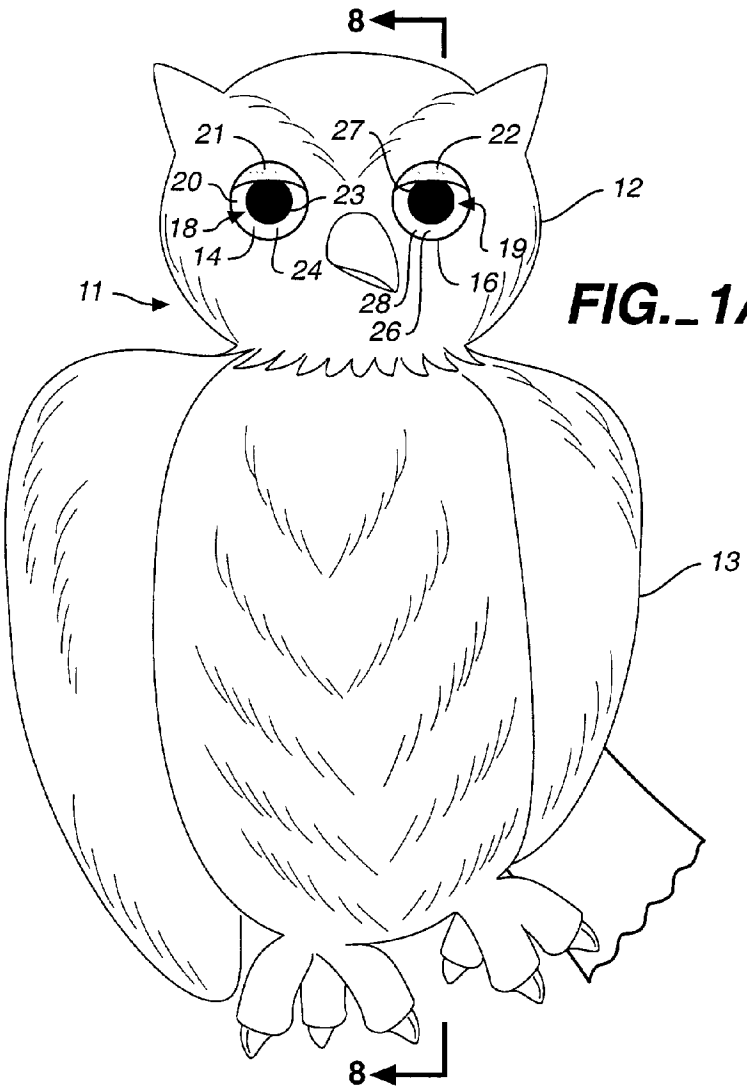
FIG. 1A is a perspective view of an owl puppet having the dynamic eye simulation mechanism of the present invention, with the eye mechanism oriented to mostly reveal the eyeball surface.
Figure 2B:
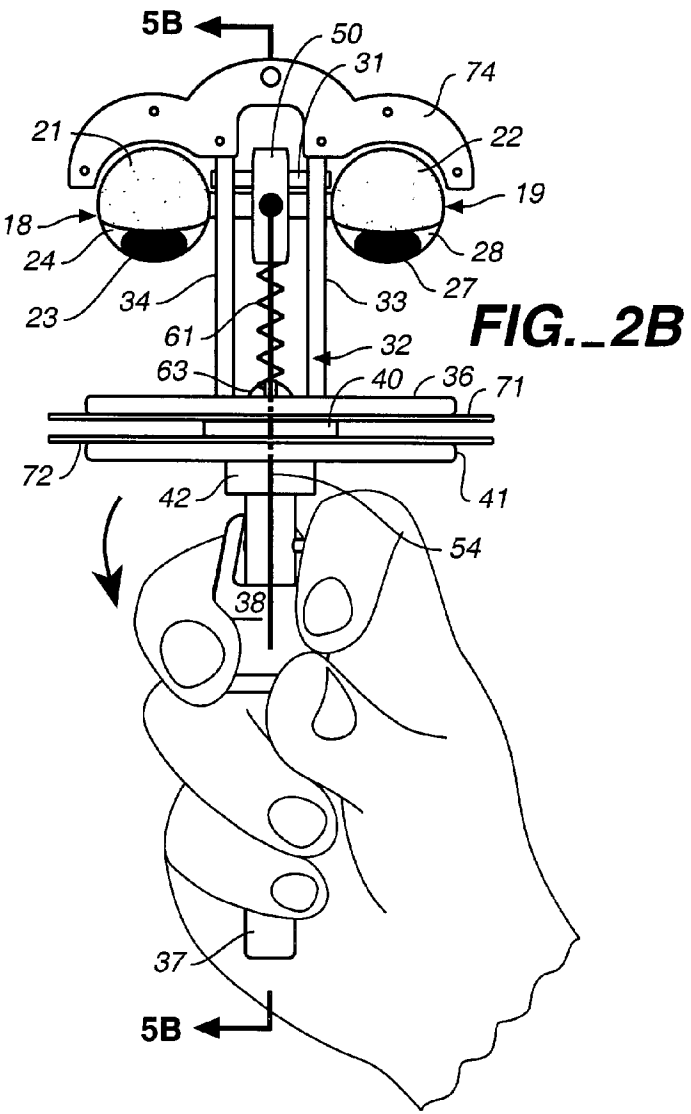
FIG. 2B is the same as FIG. 2A, with the mechanism operated to rotate the eye orbs.
Figure 2A:
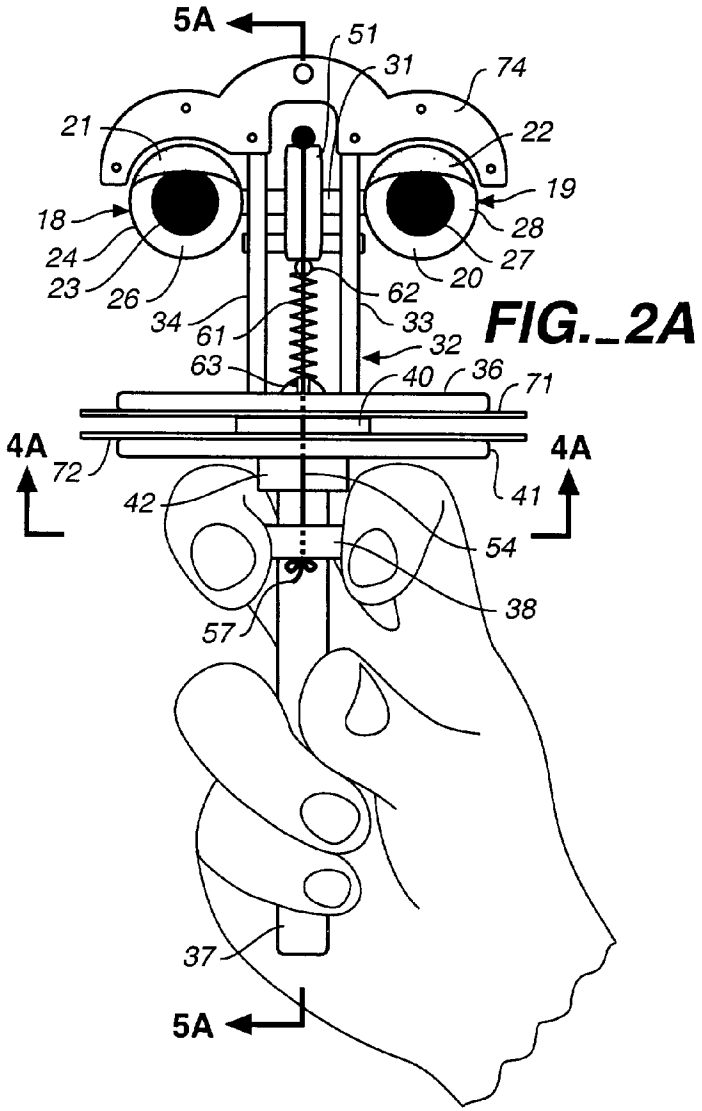
FIG. 2A is a front elevation view of the mechanism of the invention shown in conjunction with the hand of an operator.
Figure 3A:
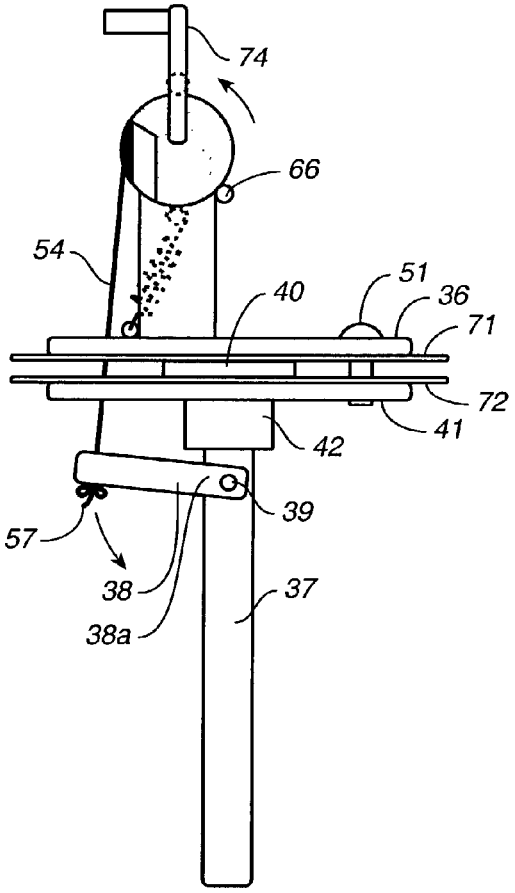
FIG. 3A is a side elevation view of the invention.
Figure 3B:
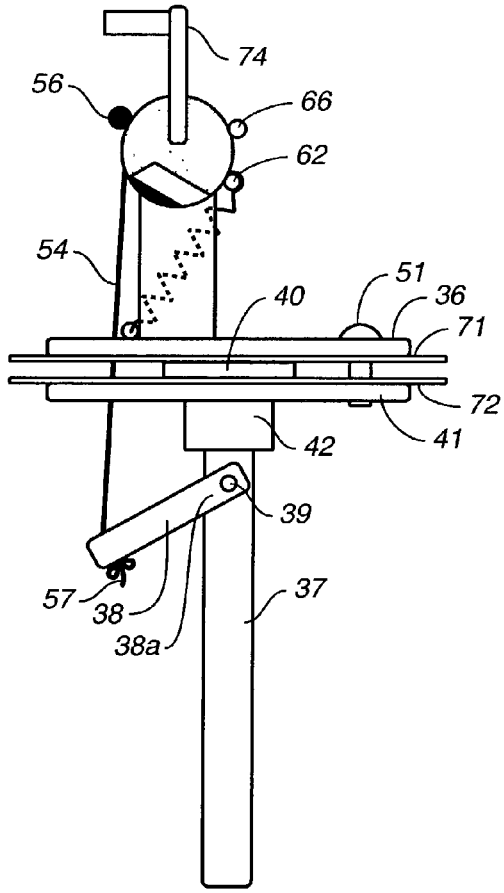
FIG. 3B is the same as FIG. 3A, with the eye orbs rotated.

Eye orbs 18 and 19 are non-rotatably affixed at either end of a shaft 31, which is rotatably secured to a support structure 32 which includes spaced-apart uprights 33 and 34 secured to an upper platform 36. Rotation of shaft 31 causes rotation of the eye orbs 18 and 19 so that the portion of the surface area of the eye orbs seen through the respective eye apertures 14 and 16 can be changed. FIGS. 1A and 2A illustrate the eye orbs 18 and 19 rotated to a position in which the eye eyeball areas 20 and 26 are aligned with and visible through the eye apertures 14 and 16, respectively, with only a small portion of the eyelid areas 21 and 22 within the eye apertures 14 and 16. FIGS. 1B and 2B illustrate the eye orbs 18 and 19 rotated so that the eyelid areas 21 and 22 occupy a location in the apertures 14 and 16 previously occupied by all or apart of the eyeball areas 20 and 26 and fill the majority of the apertures 14 and 16, respectively. The mechanism described below which causes rotation of the shaft 31, and, thus the eye orbs 18 and 19, can create one of several different eye blinking effects.

Although the eyelid area 21 is on the same sphere (or part of a sphere) as the eyeball area 20 and moves therewith (as opposed to separately therefrom), the effect of the rotation of eye orb 18, as seen through aperture 14, is the illusion of an eyelid closing or opening over an eyeball 23 and sclera 24. The same is true of eyelid area 22 on orb 19.

Figure 7B:
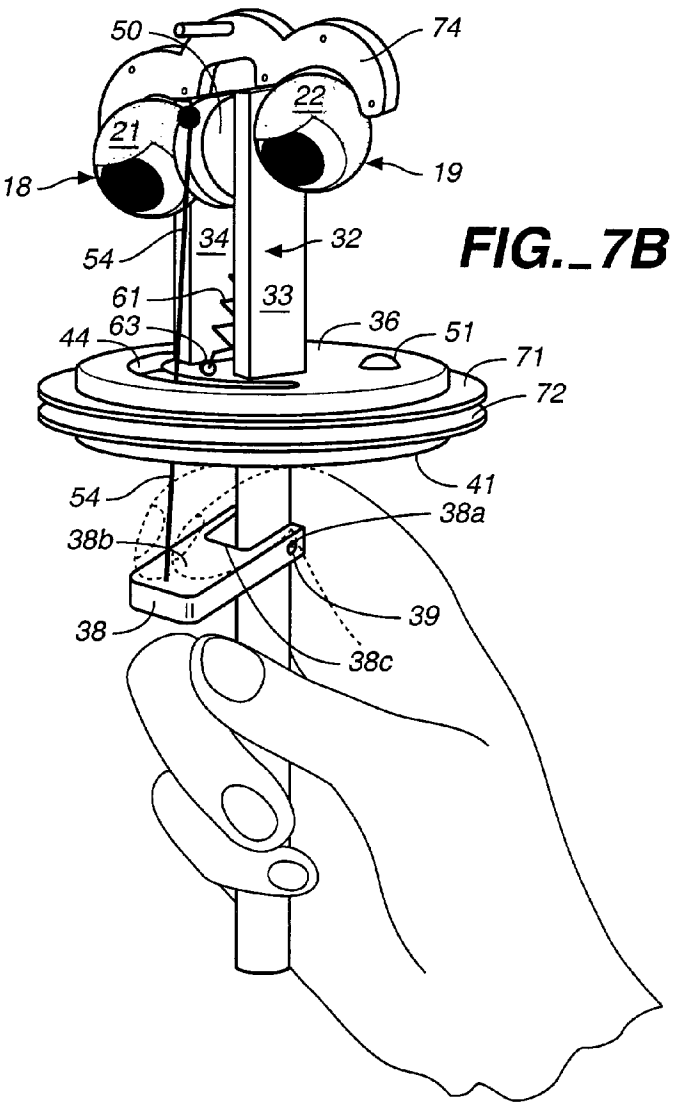
FIG. 7B is a perspective view of the invention as shown in FIG. 2B.
Figure 7A:
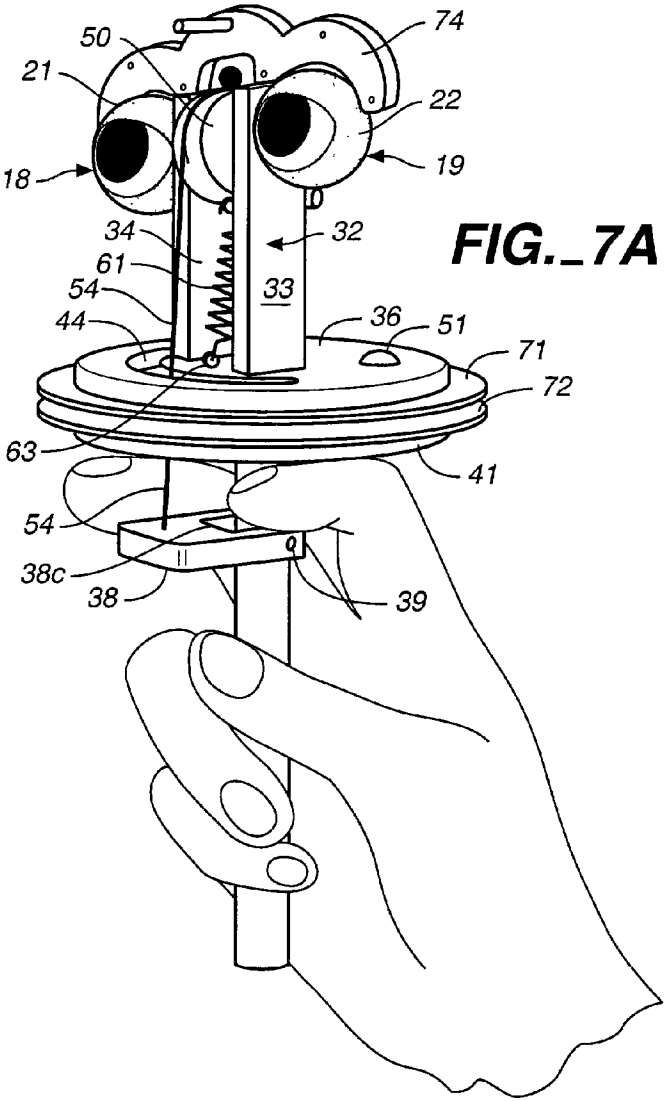
FIG. 7A is a perspective view of the invention as shown in FIG. 2A.

In the preferred embodiment, the surface of the eye orbs 18 and 19 onto which the eye pupil and surrounding sclera are applied (eyeball areas) occupy less than a full hemisphere of the eye orb so that less than 180 degrees of rotation of shaft 31 is required to produce a full eyelid closure effect, as best seen in FIGS. 7A and 7B. It will be obvious to those skilled in the art that the precise representation of an eye pupil and sclera may vary, as can the relative proportions of the eyelid area 21 and the eyeball area 20, without departing from the invention.

Figure 4A:
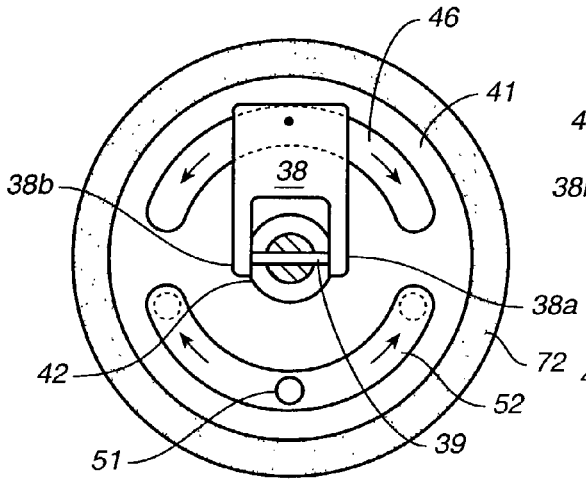
FIG. 4A is a sectional view taken along the line 4A—4A of FIG. 2A.
Figure 4B:
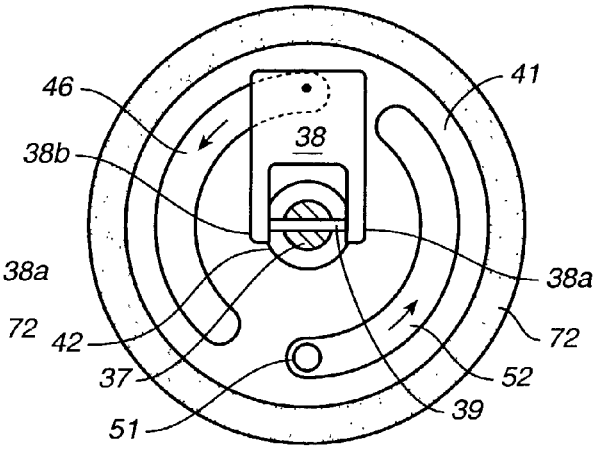
FIG. 4B is the same as FIG. 4A, with the mechanism shown rotated to a mechanical stop.
Figure 5B:
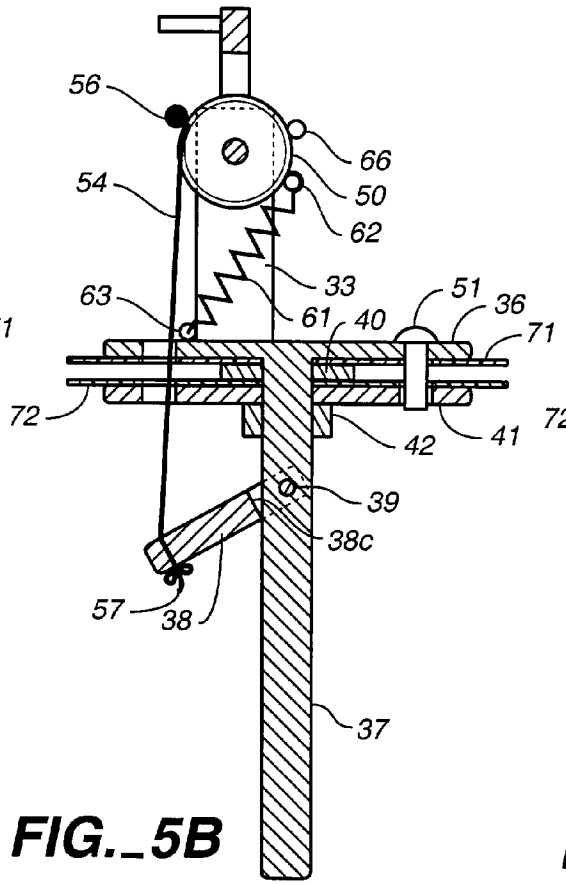
FIG. 5B is a sectional view taken through the line 5B—5B of FIG. 2B.
Figure 5A:
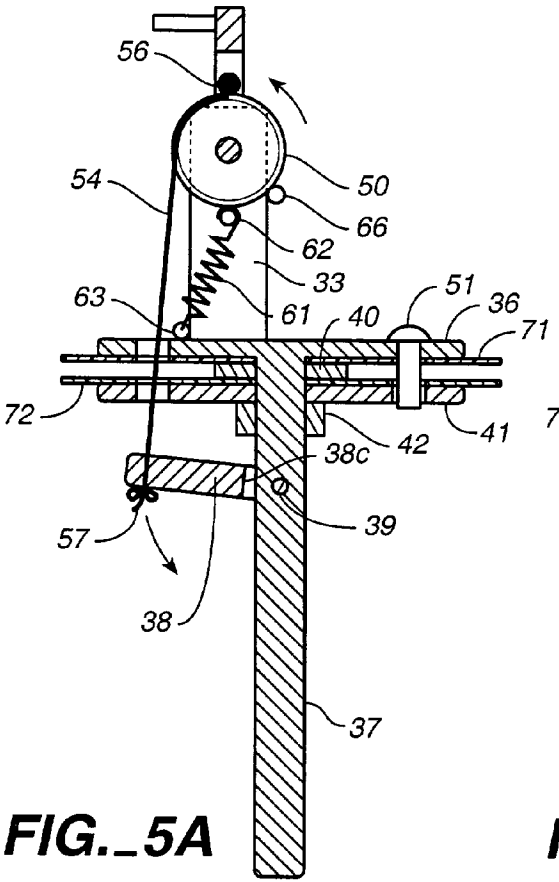
FIG. 5A is a sectional view taken along the lines 5A—5A of FIG. 2A.

Referring to FIGS. 2A, 2B, 3A, 3B, 4A, 4B, 5A, 5B and 6, the upper platform 36 is attached to a depending handle 37, to which is attached an actuator 38. As best seen with reference to FIGS. 7A and 7B, the actuator 38 has a pair of spaced-apart members 38*a* and 38*b* which are disposed on either side of handle 37 and rotatably connected thereto by a connecting pin 39. The actuator 38 can rotate about pin 39 and thereby change its angular position relative to handle 37. Actuator members 38*a* and 38*b* are joined at the back 38*c* of actuator 38. As best seen in FIGS. 5A and 5B, when actuator 38 is rotated away from platform 36 (counterclockwise), its movement in that direction is limited by the engagement of the actuator back portion 38*c* with the handle 37 (see FIG. 5B).

A lower platform 41 is rotatably attached to handle 37 immediately below and generally parallel to upper platform 36. Lower platform 41 is held in place by a collar 42, which is secured to handle 37 and spaced from upper platform 36 by spacer 40 secured to handle 37. An arcuate aperture 44 is formed in upper platform 36 spanning approximately 170 degrees. A similar arcuate aperture 46 is formed in lower platform 41. Where the two apertures 44 and 46 overlap, there is an opening that extends through the upper platform 36 and lower platform 41.

A limit pin 51 secured in upper platform 36 depends into a second arcuate aperture 52 in lower platform 41 and limits the rotation of platform 41 relative to platform 36, as shown in FIG. 4B. The second aperture 52 in platform 41 is a mirror image of the arcuate aperture 46 in the same platform, but on the opposite side of the collar 42. When platform 41 rotates relative to platform 36 (and handle 37), the extent of the rotation is limited by the engagement of pin 51 with one of the ends of arcuate slot 52, as illustrated by dashed lines 51*a* and 51*b* in FIG. 4A. FIG. 4B illustrates rotation of platform 36 relative to platform 41 as far as limit pin 51 will permit.

A drive wheel 50 is non-rotatably secured to shaft 31 between the uprights 33 and 34 of support 32. Rotation of drive wheel 50 causes rotation of shaft 31, which causes the eye orbs 18 and 19 to change positions within apertures 14 and 16. An actuator string 54 is affixed at one of its ends 56 to the periphery of drive wheel 50, and at its other end 57, to the actuator 38. The string passes through the slot 44 in platform 36 and slot 46 in platform 41. As best seen in FIG. 4B, string 54 changes its position in slot 46 of platform 41 as platform 41 is rotated relative to platform 37.

A spring 61 is attached at one of its ends 62 to the periphery of drive wheel 50 opposite the end 56 of string 54, and the other end 63 of spring 61 is secured to the platform 36 between the uprights 33 and 34.

As best seen in FIGS. 5A and 5B, the spring 61 provides a force that acts to rotate the drive wheel 50 in a clockwise direction. When no counter force is applied, the end 62 of the spring 61 (and the point of the drive wheel 50 where spring 61 is attached) will be driven to a location between the uprights 33 and 34. When the spring 61 has rotated the drive wheel 50 to the position where the end 62 of spring 61 is between the uprights 33 and 34, the end 56 of actuator string 54 is also located between the uprights 33 and 34, but at a position approximately 180 degrees from the end 62 of spring 61 (the string end 56 is at the top when the spring end 62 is at the bottom).

The length of actuator string 54 is selected so that when the end of the string 56 is located between the uprights 33 and 34, as best seen in FIG. 5A, the actuator 38 is essentially perpendicular to handle 37. When the actuator 38 is rotated away from the drive wheel 50, as best seen in FIG. 5B, drive wheel 50 is rotated in a counterclockwise direction, rotating the eye orbs 18 and 19 and, at the same time, extending the spring 61. As previously mentioned, the back member 38*c* of actuator 38 engages handle 37 and thereby limits the extent to which drive wheel 50 can be rotated by pulling on actuator string 54 and, in the preferred embodiment, that rotation is approximately 90 degrees. The limitation of rotation of drive wheel 50 by engagement of actuator 38 back member 38*c* also prevents undue stress being applied to string 54, which could cause it to break or become separated from drive wheel 50.

FIGS. 7A and 7B illustrate how the handle 37 can be grasped by a hand with two fingers over the actuator 38, which, when drawn away from the drive wheel 50, causes the eye orbs 18 and 19 to rotate approximately 90 degrees and change the appearance of the eye, as best illustrated in FIGS. 1A and 1B. The spring 61 being extended by the rotation of the drive wheel 50 provides a force urging the drive wheel 50 in a clockwise direction. The operator, by simply relieving the pressure on the actuator 38, permits the drive wheel 50 to rotate counterclockwise and "open the eyes."

Figure 6:
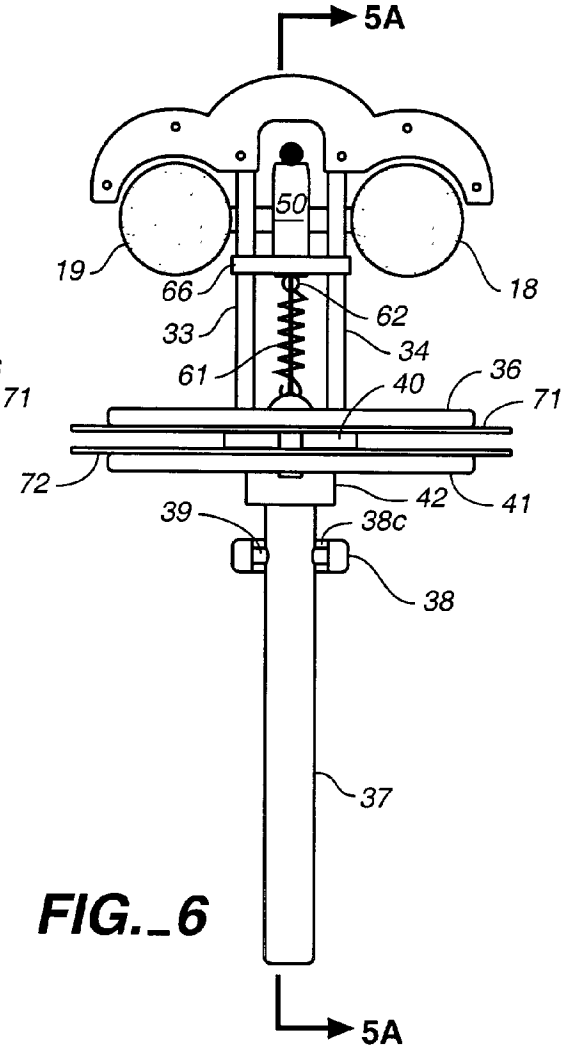
FIG. 6 is a rear view of the invention.

Referring, in particular, to FIGS. 5A, 5B and 6, drive wheel 50 has attached thereto a limiting crossbar 66, which has a length greater than the distance between the upright support members 33 and 34. The location of limiting crossbar 66 between the end 56 of string 54 and the end 62 of spring 61 determines the amount of eye area of eye orbs 18 and 19 that will be seen through the eye apertures 14 and 16 in the head member 12 when no pressure is put on the actuator 38. The spring 62 rotates the drive wheel 50 in a clockwise direction (when pressure is withdrawn from actuator 38) until limiting crossbar 66 engages the support members 33 and 34, which prevent further rotation. Thus, the location of crossbar 66 on drive wheel 50 determines the amount, if any, of eyelid areas 21 and 22 and eyeball areas 20 and 26, which are seen through their respective apertures when no pressure is applied to the actuator 38.

Figure 8:
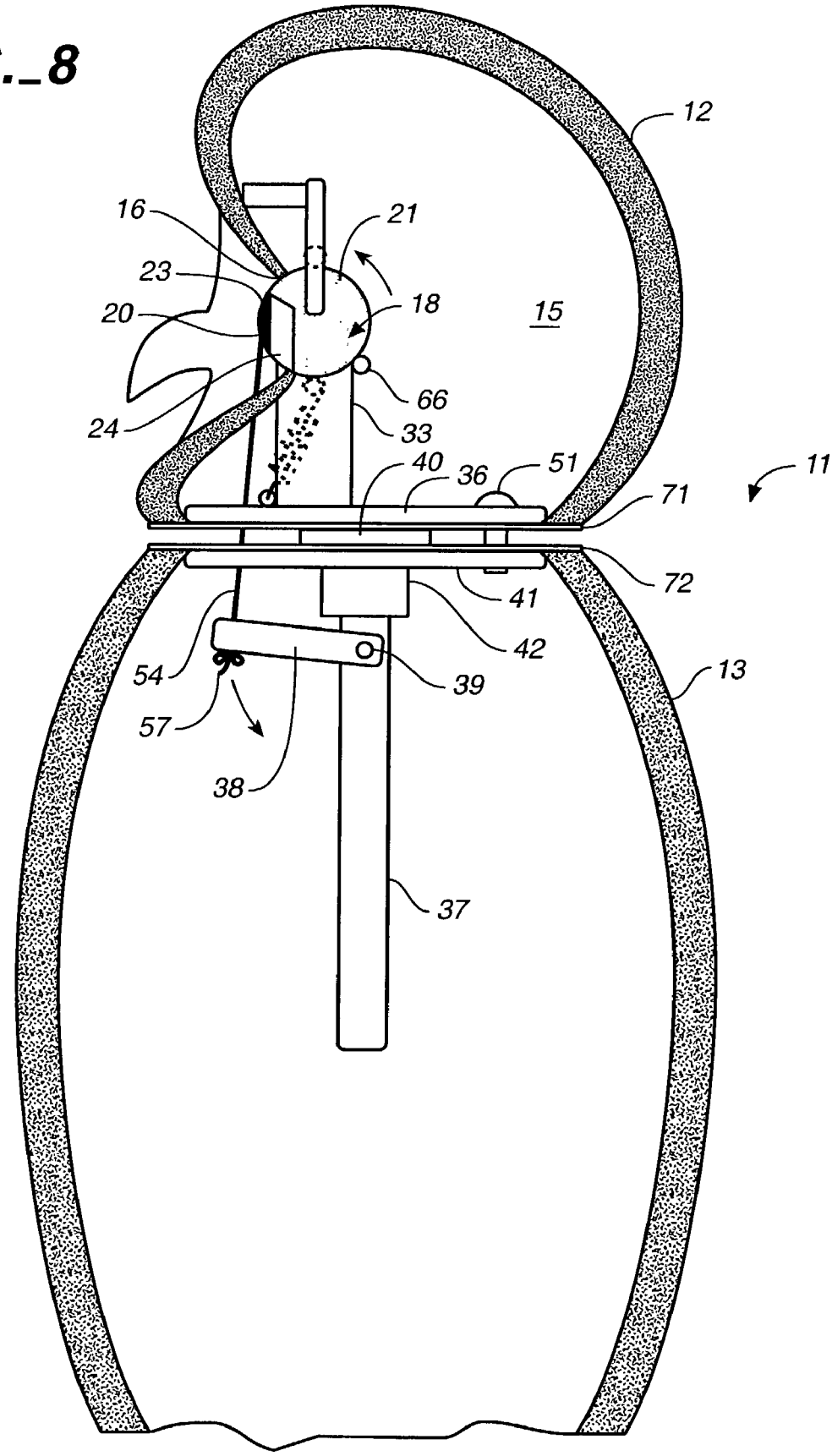
FIG. 8 is a cross-sectional view of the invention in a puppet, taken along the line 8—8 of FIG. 1.

Referring to FIG. 8, the head member 12 is secured to upper platform 36 by an upper attachment member 71, while the body portion 13 is attached to the lower platform member 41 by a lower attachment member 72. Being so attached and so separated, the head member 12 is free to rotate relative to the body member 13 while the handle 37 is being grasped by an operator, thus, giving further animation to the puppet. A yolk 74 which is attached to upright support members 33 and 34 and which spans the eye orbs 18 and 19 serves as an attachment means for the head member 12 to maintain the apertures 14 and 16 therein in alignment with the eye orbs 18 and 19.

Of course, various changes, modifications and alterations in the teachings of the present invention may be contemplated by those skilled in the art without departing from the intended spirit and scope thereof. As such, it is intended that the present invention only be limited by the terms of the appended claims.

What is claimed is:

1. A dynamic eye simulation mechanism for use in a puppet having a head portion and a body portion, comprising:

an eye orb having a generally spherical surface;

a first area of said eye orb generally spherical surface having a color simulating an eyelid which, at any given point in time, occupies a location in space;

a second area of said eye orb generally spherical surface having a representation of an eye iris and surrounding sclera which, at any given point in time, occupies a location in space;

means rotating said eye orb whereby the location in space occupied by at least a portion of one of said first and second areas is, after rotation, occupied by at least a portion of the other of said first and second areas and wherein said means for rotating said eye orb includes a shaft affixed to and extending outwardly from said orb;

means for rotating said shaft and thereby said orb;

a first platform to which said eye orb is mounted;

a second platform spaced apart from and generally parallel to said first platform.

2. The eye simulation mechanism of claim 1 where said eye orb is a sphere.

3. The eye simulation mechanism of claim 2 wherein said second area occupies less than a hemisphere of said eye orb.

4. The eye simulation mechanism of claim 1 wherein said means for rotating said eye orb further includes means for limiting said shaft rotation to less than 180 degrees.

5. The eye simulation mechanism of claim 1 wherein said means for rotating said eye orb further includes a spring which is extended when said shaft is rotated in one direction, creating a force urging rotation of said shaft in a direction opposite to said one direction.

6. The eye simulation mechanism of claim 1, further comprising:

a handle affixed to said first platform and extending through and beyond said second platform wherein rotation of said handle causes said first platform to rotate relative to said second platform.

7. The eye simulation mechanism of claim 6, further comprising:

rotation limit means limiting the rotation of said first platform relative to said second platform.

8. The eye simulation mechanism of claim 6 further comprising:

an actuator movable in two directions affixed to said handle on a portion thereof which extends beyond said second platform and;

connecting means attached to said actuator and said shaft whereby movement of said actuator in one direction rotates said shaft.

9. The eye simulation mechanism of claim 8 wherein said actuator is limited in its movement in the one direction.

10. The eye simulation mechanism of claim 8 wherein said connecting means extends through both said first and said second platforms.

11. A dynamic eye simulation mechanism, comprising:

a rotatable eye orb having a generally spherical surface;

a first area of the eye orb generally spherical surface having a color simulating an eyelid;

a second area of the eye orb generally spherical surface having a representation of an eye iris and surrounding sclera;

a first platform to which said eye orb is mounted;

a second platform spaced apart from said first platform and rotatable relative thereto;

a handle non-rotationally affixed to said first platform and extending through and beyond said second platform wherein said second platform is rotatably affixed to said handle.

12. The eye simulation mechanism of claim 1 wherein the head portion contains said eye orb and is connected to said first platform for movement therewith, and wherein the body portion is connected to said second platform.

13. The eye simulation mechanism of claim 6 wherein the head portion contains said eye orb and is connected to said first platform for movement therewith, and wherein the body portion contains said handle and is connected to said second platform whereby the head portion can be made to move relative to the body portion by rotation of said handle.

14. The eye simulation mechanism of claim 10 wherein said connecting means is a string.

15. A dynamic eye simulation mechanism for use in a puppet having a head portion and a body portion, comprising:

an eye orb having a generally spherical surface;

a shaft affixed to and extending outwardly from said orb whereby when said shaft rotates, said orb rotates;

a first platform on which said eye orb is mounted;

a handle attached to said first platform whereby the platform is supported by a hand grasping said handle; and a hand-operated actuator attached to said handle and operably connected to said shaft whereby operation of said actuator causes rotation of said shaft and said orb whereby said orb can be caused to rotate by the same hand that grasps said handle.

16. The dynamic eye simulation mechanism of claim 15 wherein said eye orb is disposed within the head portion and the head portion is attached to said first platform.

17. The dynamic eye simulation mechanism of claim 15 further comprising;

a drive wheel affixed to said shaft for rotation therewith; and wherein said actuator included is a lever mounted on said handle and operably connected to said drive wheel whereby movement of said lever causes said drive wheel to rotate, which causes said shaft and said orb to rotate.

18. The dynamic eye simulation mechanism of claim 17 further comprising;

a spring attached to said drive wheel and applying a force of rotation on said drive wheel in opposition to the direction of rotation of said drive wheel in response to said lever movement.

19. The dynamic eye simulation mechanism of claim 17 further comprising;

a stop member that limits the distance said lever can move.

20. The dynamic eye simulation mechanism of claim 18 further comprising;

a stop member that interacts with said drive wheel and limits the rotation of said drive wheel by said spring.

21. The dynamic eye simulation mechanism of claim 15 further comprising;

a second platform spaced apart from and generally parallel to said first platform wherein said handle extends from said first platform through said second platform and beyond.

22. The eye simulation mechanism of claim 21 wherein the head portion contains said eye orb and is connected to said first platform for movement therewith, and wherein the body portion contains said handle and is connected to said second platform whereby the head portion can move relative to the body portion by rotation of said handle.

* * * * *